US006081235A

United States Patent [19]

Romanofsky et al.

[11] Patent Number: 6,081,235

[45] Date of Patent: Jun. 27, 2000

[54] HIGH RESOLUTION SCANNING REFLECTARRAY ANTENNA

[75] Inventors: Robert R Romanofsky, Hinckley; Felix A. Miranda, Olmsted Falls, both of Ohio

[73] Assignee: The United States of America as represented by the Administrator of the National Aeronautics and Space Administration, Washington, D.C.

[21] Appl. No.: 09/071,450

[22] Filed: Apr. 30, 1998

[51] Int. Cl.[7] ..... H01P 1/18; H01Q 15/02

[52] U.S. Cl. ..... 343/700 MS; 343/909; 333/161; 333/156

[58] Field of Search ..... 343/700 MS, 775, 343/778, 779, 781 CA, 753

[56] References Cited

U.S. PATENT DOCUMENTS

| | | | |
|---|---|---|---|
| 4,198,640 | 4/1980 | Bowman | 343/754 |
| 4,853,660 | 8/1989 | Schloemann | 333/207 |
| 5,086,304 | 2/1992 | Collins | 343/778 |
| 5,124,713 | 6/1992 | Mayes et al. | 343/700 MS |
| 5,210,541 | 5/1993 | Hall et al. | 343/700 MS |
| 5,334,958 | 8/1994 | Babitt et al. | 333/156 |
| 5,382,959 | 1/1995 | Pett et al. | 343/700 MS |
| 5,410,322 | 4/1995 | Sonoda | 343/700 MS |
| 5,434,581 | 7/1995 | Raguenet et al. | 343/700 MS |
| 5,472,935 | 12/1995 | Yandrofski et al. | 505/210 |
| 5,543,809 | 8/1996 | Profera, Jr. | 343/753 |
| 5,561,407 | 10/1996 | Koscica et al. | 333/161 |
| 5,589,842 | 12/1996 | Wang et al. | 343/787 |
| 5,589,845 | 12/1996 | Yandrofski et al. | 343/909 |
| 5,835,062 | 11/1996 | Heckaman et al. | 343/700 MS |

*Primary Examiner*—Don Wong
*Assistant Examiner*—James Clinger
*Attorney, Agent, or Firm*—Kent N. Stone

[57] ABSTRACT

The present invention provides a High Resolution Scanning Reflectarray Antenna (HRSRA) for the purpose of tracking ground terminals and space craft communication applications. The present invention provides an alternative to using gimbaled parabolic dish antennas and direct radiating, phased arrays. When compared to a gimbaled parabolic dish, the HRSRA offers the advantages of vibration free steering without incurring appreciable cost or prime power penalties. In addition, it offers full beam steering at a fraction of the cost of direct radiating arrays and is more efficient.

39 Claims, 4 Drawing Sheets

HIGH RESOLUTION SCANNING REFLECTARRAY ANTENNA

ORIGIN OF THE INVENTION

The invention described herein was made by employees of the United States Government and may be manufactured and used by or for the Government for Government purposes without the payment of any royalties thereon or therefor.

FIELD OF INVENTION

The present invention relates to antennas and more particularly to microstrip scanning antennas, having microstrip patch elements and ferroelectric films for phase shifting, as well as, a circularly polarized microstrip antenna.

The present invention provides a High Resolution Scanning Reflectarray Antenna (HRSRA) for tracking ground terminals and space craft communication or radar applications. The method reduces the scanning quantization error to essentially zero and the aperture can be made arbitrarily large. The present invention provides an alternative to using gimbaled parabolic dish antennas and direct radiating phased arrays. When compared to a gimbaled parabolic dish, the HRSRA offers the advantages of vibration free steering without incurring appreciable cost or prime power penalties. In addition, it offers full beam steering at a fraction of the cost of direct radiating arrays.

BACKGROUND OF THE INVENTION

Microstrip antennas have interesting features for aerospace applications, in particular their low weight and thin profile. By combining patches into arrays, their inherently low directivity can be overcome. They can easily be mounted on flat or even gently curved surfaces. Printed antennas, more commonly referred to as patches using microstrip technology, can use square, circular, elliptical or even more complex shapes as radiating elements. The shape selection is dependent upon the parameters that are to be optimized, such as: bandwidth, side lobes, or cross-polarization. Since patches only radiate close to their resonant frequencies, their main dimension is about one-half-wavelength. The drawback of low directivity may be overcome by grouping a plurality of patches to form an array. A new technique is described here that permits the phasing of each patch in an array to be adjusted so as to form a main beam in an arbitrary direction.

I. Prior Art

There are several patents that disclose various reflectarrays that have been theoretically analyzed. Further, several other reflectarrays that perform at lower frequencies have been demonstrated.

II. Brief Discussion of the Prior Art

The referenced prior art that follows, show ferroelectric films for phase shifting and microstrip patch elements, as well as, circularly polarized microstrip antennas. In particular:

U.S. Pat. No. 5,589,845, granted Dec. 11, 1996, to R. M. Yandrofski, et al., discloses a tunable small patch antenna and phase shifters utilizing ferroelectric thin films and superconducting films. Also disclosed is the application of thin ferroelectric and superconducting films to tunable capacitors for microwave circuits. There is no reference to the use of these films for reflectarray antenna applications and no indication of how to design and implement phase shifting devices that are particularly suitable for such antennas. References were only to microstrip and coplanar waveguide delay lines, where recognition to the performance advantages of the couple line phase shifter design was extant. Yandrofski, et al, only alludes to phased array antennas in a generic sense. An important distinction between the phased array antenna technology understood by Yandrofski, et al, and the novel reflectarray antenna herein disclosed is that the former requires a beamforming manifold. The delay lines referred to would ostensibly be incorporated within this manifold to provide beam steering. Further disclosed is an inaccurate generalization that microwave performance of such devices is limited mostly by the loss tangent of the ferroelectric dielectric layers.

U.S. Pat. No. 5,589,842, granted Dec. 31, 1996, to J. J. H. Wang, et al, discloses a compact broadband microstrip antenna of patch elements with a ferromagnetic substrate. Wang, et al, further discloses a compact, broadband antenna subsystem, of 300% bandwidth, that can generate particular modes of radiation. This antenna may be loaded with ferromagnetic material to effect the moding and reduce the size. The tuning, as disclosed, relates to frequency agility only. Consequently, this antenna design does not rely on ferroelectric technology for operation; wherein the use of phase shifters to effect beam scanning is not disclosed.

U.S. Pat. No. 5,561,407, granted Oct. 1, 1996, to T. K. Koscica, et al., discloses a single substrate ferroelectric phase shifter. Further disclosed is a multiple section microstrip line woven over a ferroelectric layer. The circuit, as disclosed by Koscica, et al., provides a limited predetermined and discrete amount of phase shift. As a result, this type of phase shifter could result in somewhat degraded phased array performance because of the granularity in the scanned antenna pattern.

U.S. Pat. No. 5,543,809, granted Aug. 6, 1996, to C. K. Profera, Jr., et al., discloses a planar reflectarray antenna for satellite communications. Incorporated by Profera, is a dual-polarized reradiating antenna subsystem. This design permits frequency reuse because of orthogonally polarized dipole antenna elements. What is disclosed is detailed as how to control the phasing of each element of the array in order to form a cophasal (collimated) wave front. This design is intended for use in a fixed beam system, without including the use of ferroelectric phase shifters or any other type of phase shifting device.

U.S. Pat. No. 5,472,935, granted Dec. 5, 1995, to R. M. Yandrofski, et al., discloses a tunable microwave ferroelectric patch antenna and phase shifter. This design details tunable, low-loss microwave devices that are based on thin ferroelectric and superconducting films, but no specific phase shifter or phased array antenna designs are provided.

U.S. Pat. No. 5,434,581, granted Jul. 18, 1995, to G. Raguenet, et al., discloses a broadband antenna of subarray patches on a dielectric substrate. Further disclosed is a technique for enhancing the bandwidth of a microstrip patch antenna, or an array of such patches. This technique involves encasing the patch in a metal cavity with various but specific geometry.

U.S. Pat. No. 5,382,959, granted Jan. 17, 1995, to T. A. Pett, et al., discloses a high performance broadband circular polarization and microstrip patch array antenna complex. The invention presents a technique for obtaining a broad bandwidth, low axial-ratio antenna, not a scanning or phased array antenna subsystem. Each patch is sequentially rotated and phased accordingly to produce a nearly circularly polarized radiated field. Also, disclosed is how to design or select the substrate material between the driven and parasitic patch antennas. However, there is no direct relationship between Pett, et al and the present invention. The HRSRA disclosed herein provides a technique and a method for producing phase agile antennas, regardless of the type of polarization.

U.S. Pat. No. 5,334,958, granted Aug. 2, 1994, to R. W. Babbitt, et al., discloses a ferroelectric slab microstrip phase shifter, where a plurality of phase shifters are formed as a single unit. The phase shifting technique of Babbitt, et al., exploits a slab of ferroelectric material upon which the microstrip line is patterned. This same line is then biased and an electric field is generated in the slab perpendicular to the propagation velocity. This is a rather brute force approach to providing a ferroelectric phase shifter. This design does not lend itself to monolithic integration with an array of antenna elements and there is no reference made to any reflectarray implementation.

U.S. Pat. No. 5,210,541, granted May 11, 1993, to P. Hall., et al, discloses microstrip patch arrays for satellite communications using circularly polarized beams. Detailed is an antenna that is capable of an arbitrarily large number of radiating beams. The intended use is for simultaneous or switched coverage of a wide field of view. A technique for producing circularly polarized radiation is also discussed. This antenna design, however, is not intended to provide multiple scanning beams, only fixed multiple beams. Furthermore, no method of inserting phase shifting devices is disclosed, nor is there any reference to any type of ferroelectric phase shifter.

U.S. Pat. No. 5,124,713, granted Jun. 23, 1992, to P. E. Mayes, et al., discloses a planar microstrip thin patch antenna of subarrays for reception of circularly polarized signals. This invention relates to a bandwidth improved circularly polarized patch antenna. The bandwidth improvement over prior art is obtained by using multiple slots at strategic locations in the ground plane to couple to microstripline in order to excite multiple modes in proper phase relationships. While such an antenna could certainly be used in a phased array application this invention bears no other relationship to the ferroelectric phase shifter based reflectarray disclosed, herein.

U.S. Pat. No. 4,853,660, granted Aug. 1, 1989, to Ernst F. R. A. Schloemann, discloses ferromagnetic film dielectric substrate and microwave devices. Detailed is a multilayer ferromagnetic circuit than can be tuned with an appropriate magnetic field. The proposed uses for this structure are tunable bandstop microwave filters and microwave switches. It is conceivable that the structure could be used for phase shifting of a microwave signal. However, Schloemann's invention is based on ferromagnetic effects, as opposed to ferroelectric effects. The basic materials' technology is different, and the method to control the circuitry is entirely different. However, Schloemann does not describe how one would use the device for phased array antenna applications, and makes no mention of reflectarray antennas. Schloemann's circuit structure bears no resemblance to a coupled microstripline configuration.

U.S. Pat. No. 3,906,514, granted Sep. 16, 1975, to H. R. Phelan, discloses an element array for use with a plurality of similar element antennas in an array. The element antenna receives and re-radiates circular polarized electromagnetic energy, such that the re-radiated energy is of the same polarity as the received energy. Further disclosed is a version utilizing a dual polarization spiral element antenna wherein the spiral arms length and spiral diameters are chosen and configured to achieve phase control.

To achieve phase control, Phelan discloses the use of interleaved spiral arms that are connected by diodes. The number of bits of phase shift is limited by the allowable number of arms that are practically interwoven. Hence, the resulting antenna pattern suffers from seriously limited phase quantization. Further, the efficiency of this antenna is limited by impedance mismatches between the antenna elements and the switching devices (i.e., diodes).

Reflectarrays have been theoretically analyzed and several reflectarrays at lower frequencies have been demonstrated. A basic concept, that was based on the use of spiral elements, was introduced H. R. Phelan in 1975. Later, a fixed beam microstrip patch reflectarray has been demonstrated, but did not provide scanning capabilities.

The present invention differs from the aforementioned prior art in that the approach is not limited by the insertion loss or power handling capability of the switching diodes. More importantly, it offers a continuously variable phase shift capability, which results in a much higher scan resolution. As previously discussed, the prior art is limited to approximately two bits of phase shift, whereas the design described herein provides phase shifting capabilities of an arbitrary resolution. Consequently, the antenna pattern provides full hemispherical coverage as opposed to a finite number of discrete beams that is characteristic of the technology currently in use.

The newly designed reflectarray scanning antenna utilizes a space-fed approach and integrates phase shifters on the same surface as the antenna elements. It has been demonstrated in the reflectarray antenna that for the coupled line phase shifters and at high frequencies, the patterned conducting layer dominates the microwave losses.

Accordingly, it is therefore an object of the present invention to provide a high resolution scanning reflectarray antenna that provides continuously variable phase shifting capability as opposed to a discrete phase shifting mode of operation.

It is another object of the present invention to provide a high resolution scanning reflectarray antenna that utilizes coupled line structures layered upon thin ferroelectric films to realize a phase shifting element.

It is still another object of the present invention to provide a high resolution scanning reflectarray antenna that uses microstrip patch radiators in lieu of spiral elements.

It is still yet another object of the present invention to provide a high resolution scanning reflectarray antenna that captures the most desirable attributes of the parabolic reflector and direct radiating phased array.

It is another object of the present invention to provide a high resolution scanning reflectarray antenna that provides full beam steering at a reduced or minimal manufacturing cost.

An additional object of the present invention is to provide a high resolution scanning reflectarray antenna that is also conformal with the exception of the feed horn.

Still, an additional object of the present invention is to provide a high resolution scanning reflectarray antenna that provides improved antenna efficiency through a reduction in the power loss per element.

It is a final object of the present invention to provide a high resolution scanning reflectarray antenna that provides a simpler biasing scheme.

These as well as other objects and advantages of the present invention will be better appreciated and understood upon reading the following detailed description of the presently preferred embodiment taken in conjunction with the accompanying drawings.

SUMMARY OF THE INVENTION

The High Resolution Scanning Reflectarray Antenna (HRSRA) is comprised of circularly polarized metallic microstrip rectangular patch antenna elements, having a side length of approximately $\lambda g/2$, where $\lambda g$ is the guided wavelength that is inversely proportional to the frequency. Each patch element is separated from a metallic ground plane by a dielectric layer that is much less than one guided wavelength in thickness. Each element is connected to two sets of orthogonally separated microstrip coupled lines, which are situated upon an electrically thin ferroelectric film. These films are biased across the coupled lines with a dc voltage to effect the phase shifting capabilities. A corrugated feed horn is attached to nonmetallic struts that is situated at a predetermined distance in the far field of the antenna, of approximately $2D^2/\lambda_0$, from the reflectarray plane, where D is the diameter of the array and $\lambda_0$ is the radiation wavelength in free space.

In the preferred embodiment, the optimal arrangement for the ground plane is one having an arrangement or pattern that is analogous to that of a "checkerboard," where each of the alternating squares is of high conductivity and being immediately adjacent to alternating squares having low conductivity. This alternating pattern arrangement provides a good reflecting surface for each patch element, while reducing the specular reflection.

Mode of Operation:

The antenna is illuminated by a corrugated horn which emits circularly polarized microwave radiation. The horn is placed in the far field of the array (i.e., at a distance of greater than $2D^2/\lambda_0$). Doing so causes the array to be more or less uniformly illuminated in amplitude and phase, at the expense of spillover efficiency. Alternatively, if the array and horn are in close proximity, such that a spherical wave illuminates the array, a compensation factor is introduced to account for the spatial phase shift between the horn and the elements away from the normal between the horn and the antenna plane. This is implemented by having microstrip stubs, orthogonal to each other, connected to each antenna element and varying in length according to the compensation factor. The compensation factor can also be used to correct for the delay associated with an offset feed. Such an arrangement reduces blockage and hence improves efficiency, but at the expense of complexity. The incident circularly polarized signal is absorbed by each element of the reflectarray, routed through the stubs, which are in turn connected to the coupled line phase shifters, and re-radiated with a phase shift equal to twice the electrical length of the stubs-coupled lines arrangement. By varying the bias across the coupled lines of each element, the appropriate phase shift can be attained, for electronic scanning without any physical movement of the antenna to produce the desired beam steering.

Thus, the present invention capitalizes on the linear relationship between the phase of each element so that just a single voltage can be applied across a given "row" or "column" of the array, enormously simplifying the biasing of the array. This assumes that the ferroelectric devices can be operated with minimal hysteretic effects, which we have demonstrated. As in a conventional array, the separation between elements is of the order of half a free space wavelength depending upon the desired scan angle. The dielectric substrate which supports the antenna elements should be approximately less than one-tenth guided wavelengths thick. The ferroelectric layer can be approximately one-thousandth of the guided wavelength.

Conventional phased array antennas have control signals that are proportional to $N \times N$, or ($N^2$), which is equal to the total number of elements in the array. In the preferred embodiment of the present invention, the newly designed reflectarray antenna requires only $2 \times N$ control signals applied at bias points, in lieu of the $N^2$ control signals that are needed in conventional phased array antenna systems.

In another aspect of the preferred embodiment, a special case that provides a simplification in operation can be obtained by omitting the resistive layer. In this case, an equal voltage is applied to each patch element in a given column or row to permit scanning as a function of the angle of elevation theta ($\Theta$), with the azimuth angle phi ($\phi$), being fixed at either zero or ninety degrees.

As a further refinement of the present invention, a mechanical turnstile arrangement can be added beneath the surface of the reflectarray surface to permit hybridized mechanical and electronic scanning over all the viable space.

In still another alternative embodiment of the present invention, the metallic patch elements for the High Resolution Scanning Reflectarray Antenna (HRSRA) can also be realized by replacing the conventional conductors with High Temperature Superconducting (HTS) elements. In addition, the geometry of the patches is not restricted to be only rectangular, but can also be realized by using circular patches, having an equivalent area of their rectangular counterparts.

In yet another embodiment, the antenna is illuminated by a corrugated horn that emits a linearly polarized microwave-radiation. To implement this embodiment, each of the patch elements that is integrated into an array is adjusted in phase to form a main beam in an arbitrary direction to provide an optimal response to the linear polarized microwave radiation. Again, a similar compensation factor is introduced to account for the spatial phase shift that occurs between the horn and the elements that are away from the normal that is found between the horn and the antenna plane. In this case, this is accomplished by having a single microstrip stub connected to each antenna element in varying lengths, corresponding to the compensation factor.

BRIEF DESCRIPTION OF THE DRAWINGS

The present invention is diagrammatically illustrated in the accompanying drawings that are attached herein.

DETAILED DESCRIPTION OF THE INVENTION

Figure 1:
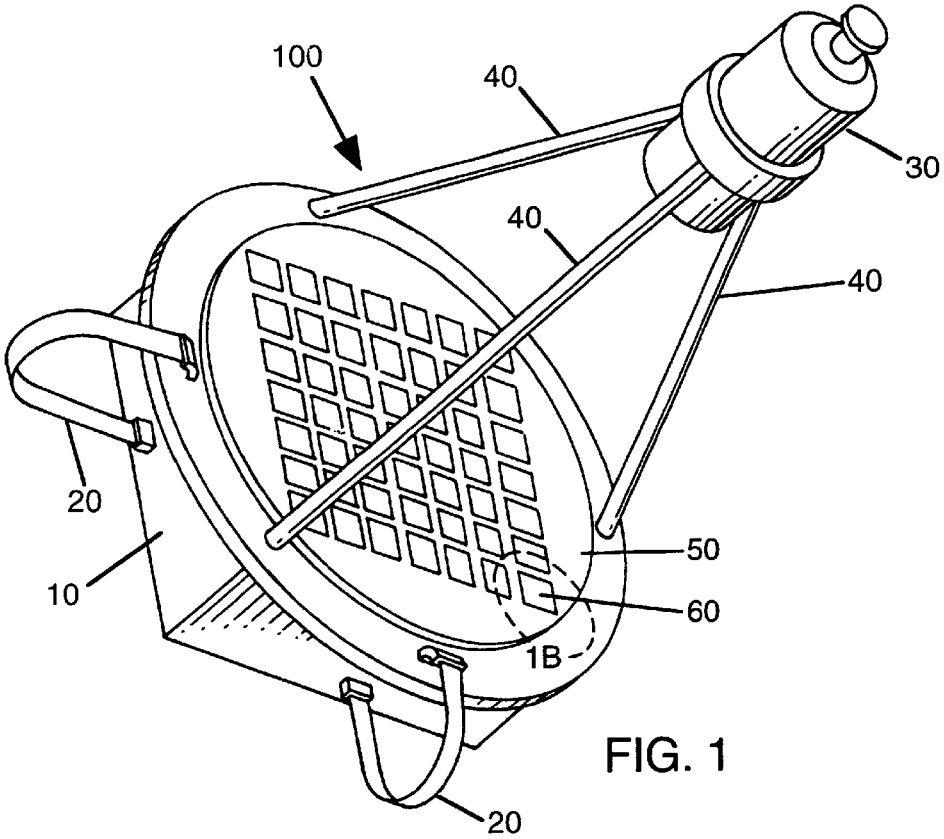
FIG. 1 is a perspective view showing a typical scanning reflectarray antenna arrangement.

In FIG. 1, there is shown a generalized depiction of the antenna 100 in accordance with the present invention. The antenna is illuminated by a corrugated horn 30 which emits circularly polarized microwave radiation. The corrugated feed horn 30 is attached to nonmetallic struts 40 and situated at a predetermined distance in the far field of the reflectarray, of nominally $2D^2/\lambda_0$, from the reflectarray plane 50. Patch elements 60 are shown in column and row configuration with a beam steering computer 10 communicating with the array through ribbon cables 20, each ribbon cable having a plurality of wires for a bias to each column and row of the patch elements. A variation of the bias provides an instantaneous electronic phase shift of the array for elevation Θ as well as azimuth ϕ tracking.

Figure 1A:
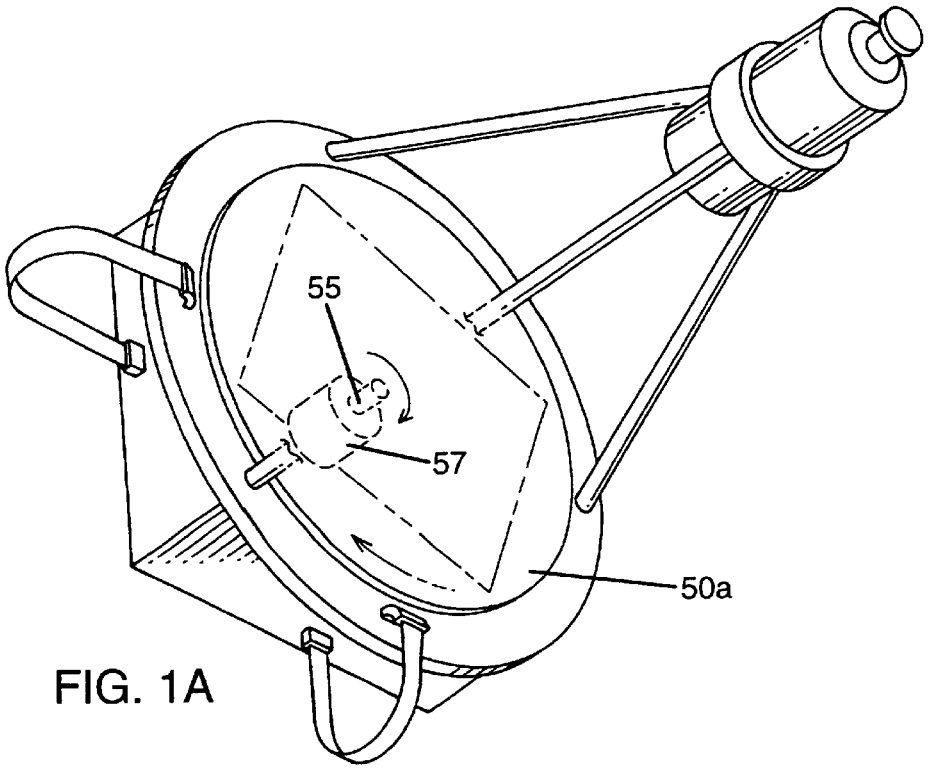
FIG. 1A is a perspective view showing an alternative embodiment for a scanning reflectarray antenna with a stepper motor and shaft for array rotation in azimuthal tracking of the antenna.
Figure 1B:
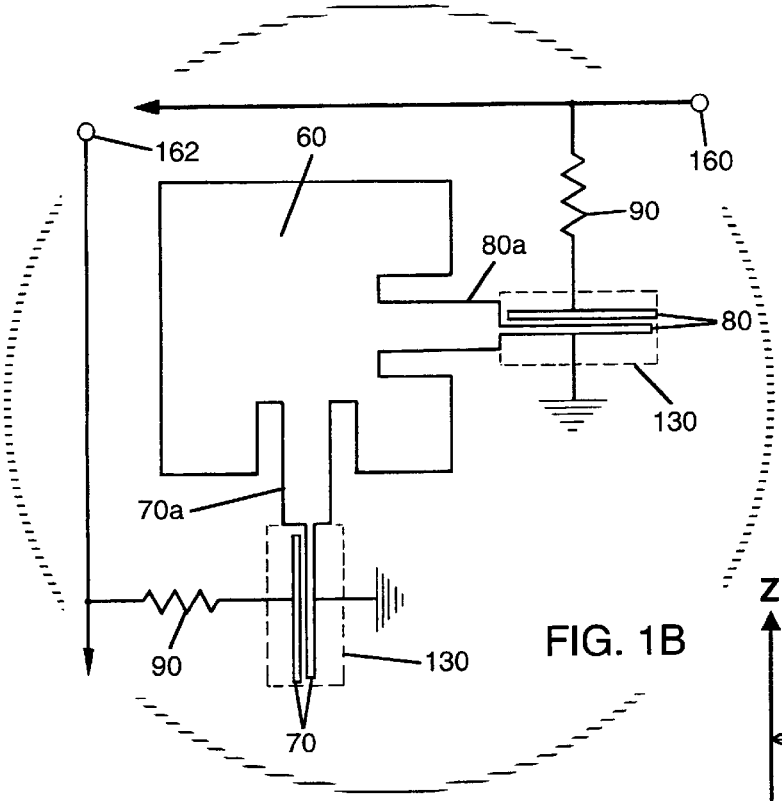
FIG. 1B is an enlarged portion of the array with a plan view of an individual patch element.
Figure 1C:
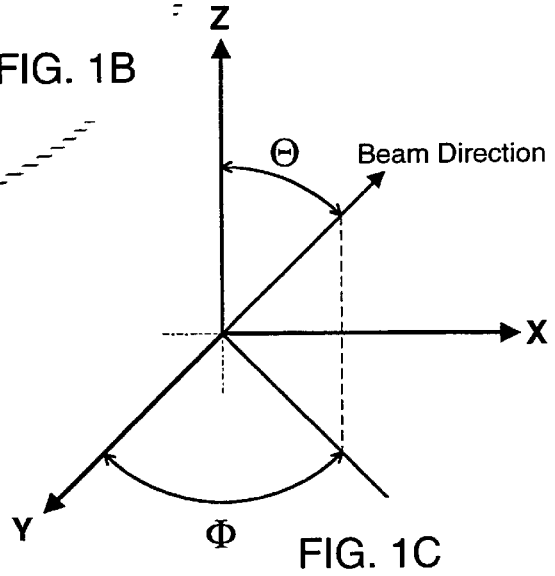
FIG. 1C is a 3-dimensional view illustrating the beam steering direction on the x, y, and z axes.

FIG. 1A discloses an alternative embodiment for the antenna that includes stepper motor 57 in combination with the foregoing electronic scanning, whereby the array can be rotated for scanning in the azimuth (ϕ) direction with consequent hybrid electronic and mechanized scanning over all visible space, shown in FIG. 1C.

FIG. 1B discloses an exploded view of an individual patch element 60 of the array, wherein the patch elements communicate with two pair of orthogonally separated microstrip coupled lines 70,80, which are situated upon the ferroelectric film layer 130, through stubs 70*a*,80*a*, and covered by the resistive layer 90 to form a coupled line phase shifting element, for integration of phase shifting elements and patch elements on the antenna surface.

Figure 2:
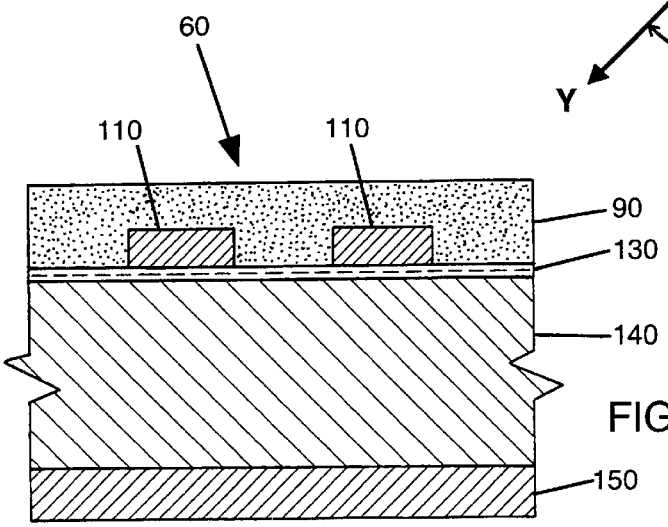
FIG. 2 is a schematic representation of a sectional view of the laminated microstrip antenna structure.

Turning now to FIG. 2, there is shown a cross-section of a patch element 60. In the preferred embodiment, the High Resolution Scanning Reflectarray Antenna (HRSRA) is comprised of circularly polarized metallic microstrip rectangular patch antenna elements. It should be understood that the cross-sectional representation of a patch element 60 in FIG. 2 is depicted schematically to portray the overall laminated structure of the reflectarray 50, wherein the conductive path to each patch element is shown as 110.

Each of the circularly polarized microstrip patches 60 have a side length of approximately λg/2. A dielectric layer 140, that is electrically thin, separates the patch elements 60 from the conductive ground reference layer 150. Resistive layer 90 provides a voltage dropping element.

Figure 3:
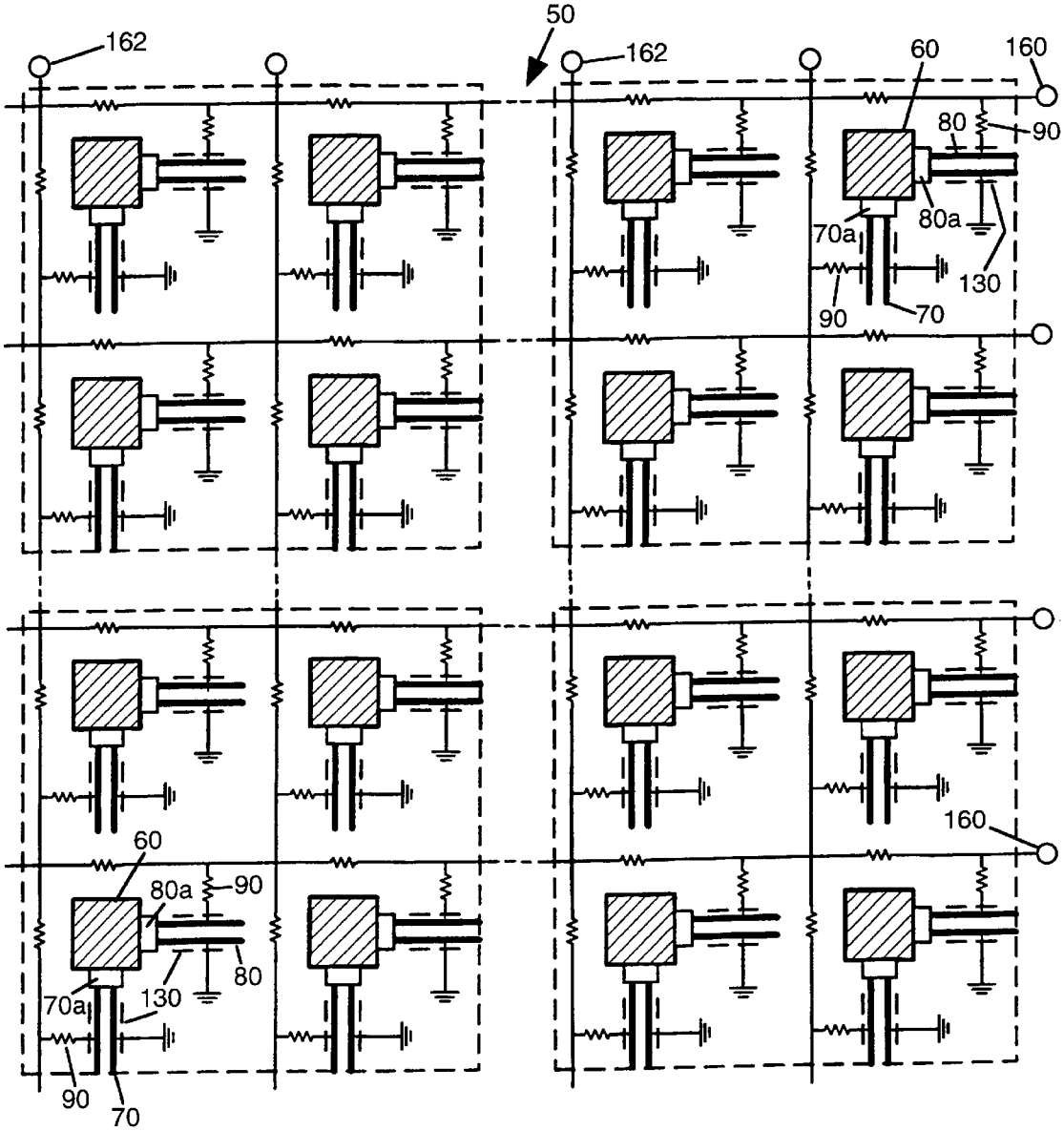
FIG. 3 is a plan view of the integrally formed microstrip radiator patches and feedline structure of the preferred embodiment.

Referring now to FIG. 3, the reflectarray plane 50 is shown, bearing a plurality of patch elements 60, wherein each array element 60 is connected to two sets of orthogonally separated microstrip coupled lines 70,80 through resistive layer 90. The coupled lines 70,80 are defined in an electrically thin ferroelectric film 130. These films are biased across the coupled lines with a DC voltage input at row bias points 160 and column bias points 162, to effect the phase shifting capabilities beyond 360°. If antenna orientation is arbitrary, linearly polarized microstrip patches can be used.

Because of the flat profile of the array, a compensation factor is introduced to account for the spatial phase shift between the horn 30 and the elements 60 away from the normal between the horn and the antenna reflectarray plane 50. This is implemented by the microstrip stubs 70*a* and 80*a*, each stub being orthogonal to the other connected to their respective element 60. As such, the compensation factor varies according to the electrical length of the stubs (70*a*, 80*a*)—coupled lines (70,80) arrangement.

The incident circularly polarized signal is absorbed by each array element of the reflectarray 50 and routed through the stubs, which are in turn connected to the coupled line phase shifters 70 and 80, whereupon the signal is re-radiated with a phase shift equal to twice the electrical length of the stub-coupled lines arrangement. By varying the bias across the coupled lines of each element, through voltage applied at bias points 160,162, the appropriate phase shift can be attained to produce the desired beam steering. The bias scheme can be controlled by a beam steering computer 10 as in a conventional array and the bias signals can be routed over ribbon cables 20 or equivalent. Since the current draw and power dissipation are essentially negligible, the ribbon cables preferably contain multistranded wire of very thin gauge.

The present invention thereby capitalizes on the linear relationship between the phase of each element so that just a single voltage can be applied across a given "row" or "column" of the array, greatly simplifying the biasing of the array.

In the alternative embodiment of the present invention, shown in FIG. 1A, a much simplified approach is provided by a stepper motor 57 with a shaft 55, positioned behind, and in articulation with the antenna plane 50*a*, for a turnstile arrangement. A rotary coupler (not shown) communicates with the array through the cables for application of a bias to the array using said coupler. The stepper motor 57 that rotates the shaft 55 and plane 50*a* is housed in 10 and is associated with the computer for rotation of the antenna in combination with electronic scanning to provide scanning in the azimuth (ϕ) direction by a rotation between 0 and 180 degrees for aximuthal tracking, while the ferroelectric phase shifters would provide elevation Θ tracking by electronic phase shifting and beam steering, for hybrid electronic and mechanized scanning over all visible space while maintaining a simple biasing scheme.

As in a conventional array, the separation between elements is approximately one half of a free space wavelength. The dielectric substrate 140 that supports the antenna elements 60 is generally less than one-tenth of a guided wavelength thick to minimize surface wave losses. In the preferred embodiment, the ferroelectric layer 130 should be near one-thousandth of the guided wavelength.

Figure 4:
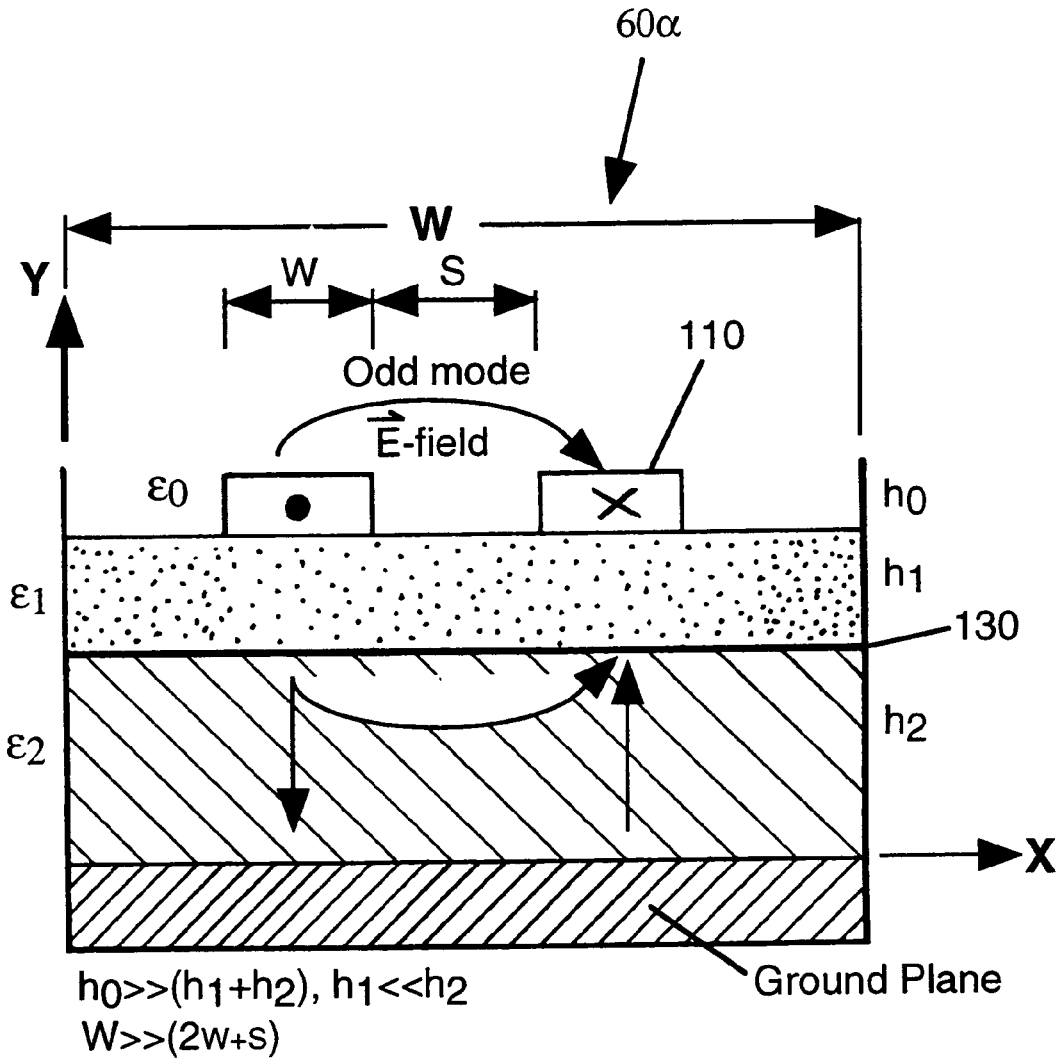
FIG. 4 is an electromagnetic model of the coupled line phase shifter that does not contain a resistive layer.

FIG. 4 illustrates the critical enabling component of the ferroelectric reflectarray, a cross-sectional view of the coupled line phase shifter 60*a*. A DC bias applied across the coupled lines lithographically defined in conductor layer 110 alters the dielectric constant of layer 130, thereby controlling the propagation velocity of the electromagnetic wave. Resistive layer 90 is not part of the electromagnetic model of FIG. 4.

As FIG. 4 demonstrates, an electromagnetic model of the coupled line phase shifter 60*a* is given in section. The design exploits the fact that the ferroelectric film is most effective when the phase velocity is dominated by the odd mode fields. The propagation constant is given by:

$$\beta=(\pi/\lambda_0)\{[\epsilon_{even}(V_{dc})]^{0.5}+[\epsilon_{odd}(V_{dc})]^{0.5}\}$$

wherein:

β=propagation constant $\lambda_0$=free space wavelength $\epsilon_{even}$=even mode effective dielectric constant $\epsilon_{odd}$=odd mode effective dielectric constant $\epsilon_{even}$ and $\epsilon_{odd}$ are, of course, functions of the applied voltage, $V_{dc}$.

In still another alternative embodiment of the present invention, the metallic patch elements 60 for the High Resolution Scanning Reflectarray Antenna (HRSRA) can also be realized by replacing the conventional conductors with High Temperature Superconducting (HTS) elements. Additionally, the geometry of the patches is not restricted to be rectangular and they can also be realized with circular patches of an area equivalent to their square counterparts.

Because the present invention can be realized by using a totally lithographic process, it can be reproduced more effectively and at a lower cost than current state-of-the-art direct radiating phased arrays.

An advantage in implementing the present invention over a conventional parabolic dish is that it not only approaches the power efficiency of a parabolic dish, but also offers vibration free and fast electronic beam steering as opposed to mechanical positioning and pointing.

What is claimed is:

1. A High Resolution Scanning Reflectarray Antenna (HRSRA) comprising:

an antenna plane including a plurality of microstrip patch radiator elements arranged in an array, each element having an associated phase shifter comprising a thin ferroelectric film layer positioned above a dielectric substrate layer and below a resistive film, wherein the dielectric substrate layer rests upon a conductive ground reference layer that is divided into squares of alternating low and high conductivity; each element in communication with a power source through a beam steering computer;

a corrugated feed horn that illuminates each element of the array by emitting a microwave radiation;

a means for continuously variable phase shifting to achieve an electronic scanning of an arbitrary resolution without any physical movement of said antenna.

2. The HRSRA according to claim 1, each of the plurality of patch elements having a pair of stubs, each stub of the pair orthogonal to the other, and each of the stubs having varying lengths corresponding to a compensation factor respective to the length of each stub to compensate for a spatial phase shift between the horn and the elements away from a normal between the horn and the antenna plane.

3. The HRSRA of claim 2, wherein each of the plurality of patch elements communicates with two pair of orthogonally separated microstrip coupled lines, that are situated upon the ferroelectric film layer, and covered by the resistive layer to form a coupled line phase shifting element, for integration of the patch elements and phase shifting elements on a same surface of said antenna.

4. The HRSRA according to claim 3, further comprising a plurality of bias points communicating with said coupled lines of the plurality of patch elements for introducing a DC bias control signal input to each element of the array.

5. The HRSRA according to claim 4, wherein the coupled lines are lithographically defined on the ferroelectric film layer and the DC bias applied across said coupled lines alters the dielectric constant of the ferroelectric layer, thereby controlling a propagation velocity of an electromagnetic wave.

6. The HRSRA according to claim 5, the means for continuously variable phase shifting comprising a variation in the DC bias across the coupled lines for a consequent instantaneous, continuously variable phase shift and a desired electronic beam steering, without vibration and more immediate, than by mechanical positioning.

7. The HRSRA of claim 6, wherein the microwave radiation emitted from the horn comprises an incident polarized signal to each element of the reflectarray, communicating through the stubs to each coupled line phase shifter element, for a re-radiated signal from each patch element, whereby a phase shift is achieved for an infinite incremental resolution and a full hemispheric coverage consequent to the continuously variable phase shift.

8. The HRSRA of claim 7, the means for compensating comprising the stubs and coupled lines forming a pair of stubs-coupled lines arrangement connected to each of said plurality of patch elements, each of the pair of stubs-coupled lines arrangement having varying lengths, radiating outwardly away from each of the plurality of patch elements.

9. The HRSRA according to claim 8, wherein the phase shift is equal to twice the electrical length of the stubs-coupled lines arrangement.

10. The HRSRA according to claim 9, wherein the plurality of patch elements of the array is arranged in columns and rows, each of said plurality of bias points communicating with a respective column and row of the array through said couple lines for a bias control signal input to each row and each column and simplification in biasing of the array.

11. The HRSRA according to claim 10, wherein a single voltage is applied to each row of the microstrip array.

12. The HRSRA according to claim 11, wherein a single voltage is applied to each column of the microstrip array.

13. The HRSRA according to claim 12, the array comprising a total of $N^2$ microstrip patch radiator elements and having only 2N control signals as opposed to $N^2$ control signals for biasing the array.

14. The HRSRA according to claim 13, the computer communicating with the array through a plurality of ribbon cables for control of a varied bias to the array and an enhanced beam steering control.

15. The HRSRA described in claim 14, wherein the horn is positioned at a predetermined distance from the antenna.

16. The HRSRA according to claim 15, wherein the antenna plane has an essentially flat profile, an essentially round perimeter and a diameter; and, wherein the feed horn is in a far field of the antenna, said predetermined distance optimally comprising $2D^2/\lambda_0$ from the antenna plane, where D is the diameter of the antenna plane, whereby the array is uniformly illuminated in amplitude and phase, at the expense of a spillover efficiency.

17. The HRSRA of claim 16, further comprising nonmetallic struts that attach the horn to the antenna, for an HRSRA that is conformal except for the feed horn.

18. The HRSRA according to claim 17, wherein the horn produces a circularly polarized microwave radiation and each of the plurality of patch elements is circularly polarized, whereby the radiation emitted from the horn provides a circular polarization to each of the plurality of microstrip elements of the array.

19. The HRSRA according to claim 17, wherein said horn emits a linearly polarized microwave radiation; and, wherein each of the patch elements of the array is adjusted in phase to form a main beam in an arbitrary direction for an optimal response to the linear polarized microwave radiation.

20. The HRSRA described in claim 18, wherein each of said plurality of patch elements has an arbitrary identical shape and an optimal area.

21. The HRSRA described in claim 20, wherein each of said plurality of patch elements has an identical essentially square shape with the optimal area.

22. A High Resolution Scanning Reflectarray Antenna (HRSRA) comprising:

a reflectarray antenna having an essentially flat antenna plane with a plurality of microstrip patch radiator elements each having an independent voltage input through two pair of coupled lines defined on a thin ferroelectric film layer with a bias across each pair of coupled lines comprising a pair of phase shifters each having a continuously variable phase shift beyond 360° without any quantization error;

a feed horn connected to the antenna for emitting a microwave signal that is re-radiated by each element;

a means for compensating for a spatial phase shift between the horn and the antenna plane; and, a means for controlling the continuously variable phase shift versus a discrete phase shift, for a full hemispherical coverage of the antenna.

23. The HRSRA according to claim 22, wherein the thin ferroelectric film is positioned above, and separated from, a conductive ground layer by an electrically thin dielectric substrate layer and covered by a resistive layer; and, wherein the thin ferroelectric film layer includes dielectric properties for alteration by a minimal DC voltage input.

24. The HRSRA according to claim 23, the plurality of microstrip patch radiator elements comprising a total of $N^2$ elements arranged in an array of columns and rows, each column and row having an associated bias point for input of an independent voltage to each column and row comprising 2N control signals to bias the array.

25. The HRSRA according to claim 24, wherein the ferroelectric film layer has a thickness and a phase shift directly proportional to the thickness of the ferroelectric film layer.

26. The HRSRA according to claim 25, the thickness of the ferroelectric film layer comprising essentially one-thousandth of a guided wavelength, for maximum tunability within achievable ferroelectric film process constraints.

27. The HRSRA according to claim 26, the ferroelectric film layer including an electromagnetic wave having a phase velocity with even and odd mode fields; and, wherein the phase velocity is dominated by the odd mode fields for a maximum effectiveness of said ferroelectric film.

28. The HRSRA according to claim 27, wherein each of the plurality of patch elements has a side length, wherein the side length of each patch element is approximately $\lambda g/2$, whereby the patch element side length is inversely proportional to a frequency.

29. The HRSRA according to claim 28, the means for compensating comprising a pair of stubs connected to each of said plurality of elements, the stubs having varying lengths, radiating outwardly away from each of the plurality of elements; and, wherein each stub of the pair of stubs is orthogonal to the other.

30. The HRSRA of claim 29, wherein each of the stubs of a stub pair has an associated compensating factor determined by a stub length, such that the compensating factor of each stub is essentially equal to twice an electrical length of that stub.

31. The HRSRA described in claim 30, further comprising a computer communicating with the array through a pair of ribbon cables, each cable having a plurality of wires for biasing each column and row of the patch elements; and, wherein said means for controlling a variable phase shifting comprises a variation in a bias across the coupled lines of each element, said variation controlled by the computer, with a commensurate infinitely variable phase shift of the array for electronic scanning and a consequent beam steering without any physical movement or vibration of the antenna.

32. The HRSRA according to claim 31, further comprising a stepper motor associated with the computer, the motor having a shaft that articulates with that antenna plane, a rotary coupler communicating with the array through said cables for application of a bias to the array using said coupler; and, the motor in articulation with said plane through the shaft for rotation of the plane as a turnstile, with rotation of the antenna in combination with electronic scanning to provide scanning in the azimuth ($\phi$) direction by a rotation between 0 and 180 degrees in an azimuthal tracking, concomitant with an elevation $\Theta$ tracking achieved by an electronic phase shifting and beam steering, for hybrid electronic and mechanized scanning over all visible space while maintaining a simple biasing scheme.

33. A High Resolution Scanning Reflectarray Antenna (HRSRA) comprising:

an antenna reflector including a plurality of metallic microstrip patch radiator elements positioned in an array on a reflectarray plane, wherein each of the plurality of microstrip elements communicates with a power source through a phase shifter, comprising a thin ferroelectric film layer having a dielectric constant and two pair of orthogonally separated microstrip coupled lines;

a corrugated feed horn situated in a far field from the reflectarray plane for emitting a microwave radiation to illuminate the reflectarray plane;

a means for a continuously variable phase shifting of the antenna by altering the dielectric constant of the ferroelectric layer; and, the power source comprising an independent voltage source in communication with each said element of the plurality through interconnecting bias points and the couple lines of the reflectarray.

34. The HRSRA according to claim 33, each of the plurality of patch elements and coupled microstrip lines comprising High Temperature Superconducting (HTS) patch antenna elements, each element having a predetermined area, and each of the elements arranged in columns and rows in the array of the reflectarray plane.

35. The HRSRA according to claim 34, wherein each of said plurality of HTS elements has an essentially square shape with an area identical to the predetermined area.

36. The HRSRA according to claim 34, wherein each of the plurality of HTS elements has an essentially circular shape with an area equal to the predetermined area.

37. The HRSRA according to claim 34, wherein each of said plurality of HTS elements has any arbitrary shape with an area equal to said predetermined area.

38. A Scanning Antenna comprising:

an antenna plane including a plurality of microstrip patch radiator elements comprising coupled line phase shifters, formed of a thin ferroelectric film, positioned above a dielectric substrate that is situated on a conductive ground layer, the elements arranged in an array columns and rows on the plane;

a corrugated feed horn that illuminates the array by emitting a microwave radiation; further comprising a mechanical turnstile positioned beneath the reflectarray; and, wherein scanning is achieved electronically by applying a minimal DC bias, for phase shifting the thin ferroelectric film as opposed to a high bias required to tune a bulk ferroelectric material, to bias points associated with each column and row of the array for beam steering in the azimuth direction, with a hybridized mechanical steering by use of the mechanical turnstile over all visible space.

39. The Scanning Antenna according to claim 38, wherein each of the plurality of microstrip patch elements having no resistive layer, and a consequent essentially zero resistance, with an equal voltage applied to each element in a given row or column, with a consequent scanning as a function of an angle of elevation theta ($\Theta$), with an azimuth angle phi ($\phi$), fixed at zero or ninety degrees.

* * * * *